US008499665B2

(12) United States Patent
St. John et al.

(10) Patent No.: US 8,499,665 B2
(45) Date of Patent: Aug. 6, 2013

(54) TORSION CONTROL HAMMER GRIP

(75) Inventors: Robert St. John, Cheshire, CT (US); Michael Marusiak, Manchester, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 1123 days.

(21) Appl. No.: 11/512,080

(22) Filed: Aug. 30, 2006

(65) Prior Publication Data

US 2008/0053278 A1 Mar. 6, 2008

(51) Int. Cl.
*B25D 1/12* (2006.01)

(52) U.S. Cl.
USPC ..... 81/22

(58) Field of Classification Search
USPC ..... 81/20–22, 489
See application file for complete search history.

(56) References Cited

U.S. PATENT DOCUMENTS

| | | | |
|---|---|---|---|
| 2,603,260 | A | 7/1952 | Floren |
| 2,850,331 | A | 9/1958 | Curry et al. |
| 3,208,724 | A | 9/1965 | Vaughan |
| 3,877,826 | A | 4/1975 | Shepherd, Jr. et al. |
| 4,085,784 | A | 4/1978 | Fish |
| 4,188,703 | A | 2/1980 | Fish |
| 4,418,732 | A | 12/1983 | Kolonia |
| 4,660,832 | A | 4/1987 | Shomo |
| 5,289,742 | A | 3/1994 | Vaughan, Jr. |
| 5,320,001 | A | 6/1994 | Floyd |
| 5,408,902 | A | 4/1995 | Burnett |
| 5,490,437 | A | 2/1996 | Hebert et al. |
| 5,522,466 | A | 6/1996 | Harada et al. |
| 5,601,003 | A | 2/1997 | Amtenbrink et al. |
| 5,657,674 | A | 8/1997 | Burnett |
| 5,704,259 | A | 1/1998 | Riehle |
| 5,772,541 | A | 6/1998 | Buiatti |
| 5,896,788 | A | 4/1999 | Hreha et al. |
| 5,992,270 | A | 11/1999 | Hedelin et al. |
| 6,016,722 | A | 1/2000 | Gierer et al. |
| 6,052,885 | A | 4/2000 | Carmien |
| 6,128,977 | A | 10/2000 | Gierer et al. |
| 6,158,307 | A | 12/2000 | Lamond et al. |
| 6,202,511 | B1 | 3/2001 | Murray et al. |
| 6,227,075 | B1 | 5/2001 | Carmien |
| 6,234,048 | B1 | 5/2001 | Carmien |

(Continued)

FOREIGN PATENT DOCUMENTS

| | | |
|---|---|---|
| FR | 2 870 474 | 11/2005 |
| WO | WO 2006/069759 A1 | 7/2006 |
| WO | WO 2007/079787 A1 | 7/2007 |

OTHER PUBLICATIONS

European Search Report issued for European Patent Application No. 07114104.8-1262, dated Dec. 28, 2007.

*Primary Examiner* — Hadi Shakeri
(74) *Attorney, Agent, or Firm* — Pillsbury Winthrop Shaw Pittman LLP

(57) ABSTRACT

A manually operable impact tool is provided that includes an elongated rigid handle and an impact head disposed at one longitudinal end portion of the handle structure. A cushioning grip is disposed over a second longitudinal end portion of the handle structure. The cushioning grip includes an inner layer of thermoplastic rubber having a Shore A durometer in the range of about 10 to about 40, and an outer layer of thermoplastic rubber disposed over the inner layer having a Shore A durometer in the range of about 55 to about 90.

27 Claims, 6 Drawing Sheets

U.S. PATENT DOCUMENTS

| | | | | |
|---|---|---|---|---|
| 6,311,582 | B1 | 11/2001 | Chow | |
| 6,314,617 | B1 | 11/2001 | Hastings | |
| D455,626 | S | 4/2002 | Chen | |
| 6,363,817 | B1 * | 4/2002 | Lamond et al. | 81/22 |
| 6,370,986 | B1 | 4/2002 | Scott | |
| 6,467,376 | B1 | 10/2002 | Wu | |
| 6,595,087 | B2 | 7/2003 | Whalen et al. | |
| 6,619,408 | B1 | 9/2003 | Lai | |
| 6,652,398 | B2 * | 11/2003 | Falone et al. | 473/568 |
| 6,755,096 | B2 | 6/2004 | Schroder | |
| 6,872,157 | B2 * | 3/2005 | Falone et al. | 81/489 |
| 2002/0020537 | A1 | 2/2002 | Shonfeld et al. | |
| 2002/0119422 | A1 | 8/2002 | Beck et al. | |

* cited by examiner

TORSION CONTROL HAMMER GRIP

FIELD OF THE INVENTION

The present invention relates to manually operable impact tools and, more particularly, to provisions controlling the transmission of torque from an impact head to a user-engageable portion of the impact tool.

BACKGROUND OF THE INVENTION

Many tool handles, such as hammer handles, are constructed of a metal, a synthetic or a composite material. Steel and fiberglass, for example, are often used for tool handle construction. These materials offer reduced materials cost, uniformity of structure and the ability to securely and permanently affix the hammer head or other tool head to the handle. Metal, synthetic and composite handles are relatively durable as compared to wooden handles. Metal, synthetic and composite handles have some disadvantages, however. These handles tend to transfer torque (twisting about the longitudinal axis of the handle) and kinetic energy to a user's hand when a workpiece is impacted. Many hammers with metal or synthetic handles are provided with rubber or rubber-like sleeves at the free end opposite the hammer head to provide a degree of impact protection for the hand of the user. Most of these sleeves are constructed of a relatively hard, non-cushioned single material, however, and provide little or no damping. In addition, such sleeves are not engineered to address torque or torsional force applied to the user's hand that may result when the hammer head "offstrikes," for example, when the head face misses the intended target, and the side of the head hits a structure such that the impact tends to twist the hammer about a longitudinal axis of the hammer handle. U.S. Pat. No. 6,370,986 (of same Assignee as the present invention), hereby incorporated by reference in its entirety, discloses a hammer with a cushioning grip. It has been found, however, that the teachings of this patent do not sufficiently address torsional or twisting forces imparted to the hammer during impact. A need exists for an impact tool grip that can be used on metal, composite and synthetic handles that provides a high degree of torque absorption and cushioning to reduce the kinetic energy transferred to the user's hand during impact and that can be applied to these handles easily during the manufacturing process.

SUMMARY OF THE INVENTION

In accordance with an embodiment of the present invention, a manually operable impact tool is provided that comprises an elongated handle and an impact head disposed at one longitudinal end portion of the handle. The handle includes an internal core structure and a cushioning grip disposed over the core structure. The cushioning grip includes an inner layer of thermoplastic rubber having a Shore A durometer in the range of about 10 to about 40, and an outer layer of thermoplastic rubber disposed over the inner layer and having a Shore A durometer in the range of about 55 to about 90.

In accordance with a further embodiment of the present invention, a method is provided for making a manually operable impact tool. An elongated handle is provided that has an internal core structure. An impact head is disposed at a first longitudinal end of the handle and a portion of the core structure is covered with a first layer of thermoplastic rubber having a Shore A durometer in the range of about 10 to about 40. The first layer of thermoplastic rubber is then substantially covered with a second layer of thermoplastic rubber that has a Shore A durometer in the range of about 55 to 90.

In accordance with a further embodiment of the present invention, a manually operable impact tool is provided that comprises an elongated handle and has an impact head disposed at one longitudinal end portion of the handle. The handle includes an internal core structure that has a tuning fork portion. A cushioning grip is disposed over the internal core structure and includes a soft inner layer of a solid, non-foamed thermoplastic rubber and an outer layer of thermoplastic rubber disposed over the inner layer. The outer layer is harder than the inner layer.

Objects, features, and advantages of the present invention will become apparent from the following detailed description, the accompanying drawings, and the appended claims.

BRIEF DESCRIPTION OF THE DRAWINGS

The above-mentioned and other features and advantages of the present invention, and the manner of attaining them, will become more apparent and the disclosure itself will be better understood by reference to the following description taken in conjunction with the accompanying drawings, wherein.

Figure 1:
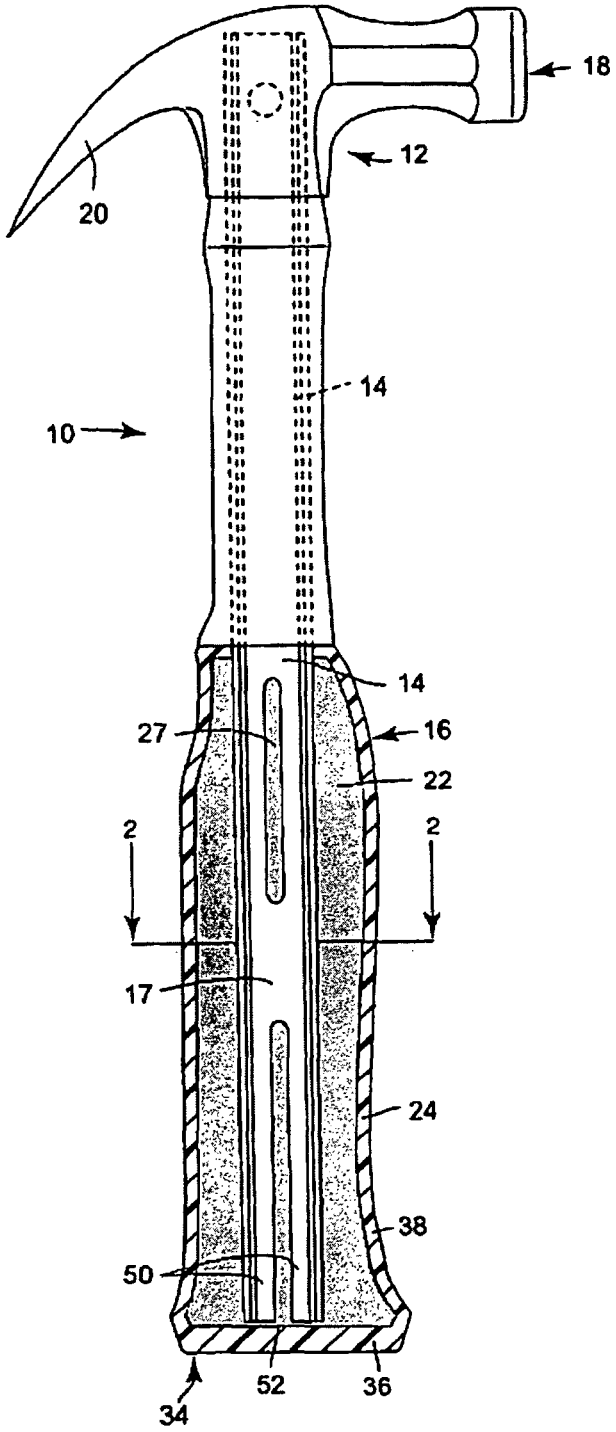
FIG. 1 is a partially cross-sectional view of an exemplary manually operable impact tool in accordance with an embodiment of the present invention.

The present invention will be described with reference to the accompanying drawings. Corresponding reference characters indicate corresponding parts throughout the several views. The description as set out herein illustrates an arrangement of the invention and is not to be construed as limiting the scope of the disclosure in any manner.

DETAILED DESCRIPTION OF THE INVENTION

FIG. 1 is a cross-sectional view of a manually operable impact tool, generally designated 10, constructed according to the principles of the present invention. The impact tool shown is a carpenter's or "claw" hammer, but this is exemplary only and not intended to be limiting. It is within the scope of the invention to apply the principles of the invention to any type of hand tool used to manually impact a workpiece.

The manually operable impact tool 10 includes an impact head 12 (which is not cross sectioned in FIG. 1 to more clearly illustrate the invention), an internal core structure 14 extending longitudinally with respect to the manually operable impact tool 10 and an exterior impact-cushioning gripping structure 16 affixed to a lower portion 17 of the internal core structure 14 in surrounding relation thereto.

The impact head 12 for the hammer shown is of conventional construction and is preferably made of steel or other appropriate metal, formed by forging, casting, or other known methods. The impact head 12 includes a striking surface 18 and optionally may include nail removing claw 20.

The internal core structure 14 is a rigid structural member that supports the impact head 12. In one embodiment, as shown in FIG. 1, the internal core structure 14 is an I-beam structure having a vibration reducing "tuning fork" portion toward the handle end thereof, as disclosed fully in U.S. Pat. No. 6,202,511, issued Mar. 20, 2001, which is hereby incorporated by reference in its entirety. The internal core structure 14 may have an internal slot 27 for more firmly embedding surrounding layers therein. While it has been found that the anti-vibration characteristics of the impact-cushioning gripping structure are particularly effective when used with the aforementioned preferred internal core structure 14, the cushioning gripping structure of the present invention is beneficial to other types of handle structures as well. Thus, the present invention contemplates that other known interior handle structures may be used.

Figure 2:
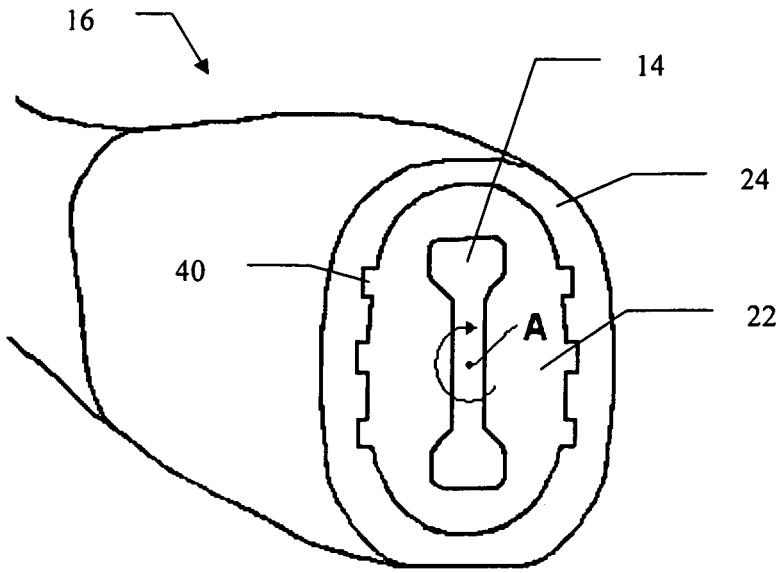
FIG. 2 is a cross-sectional view of a handle portion of a manually operable impact tool in accordance with an embodiment of the present invention.

The internal core structure 14 shown in FIGS. 1-2 is made of forged steel, but any interior handle constructed of a metal, composite or synthetic material can be used in the hammer construction. The impact head 12 can be affixed to the internal core structure 14 in any conventional manner, or alternatively, the head can be integrally formed with core structure 14. In one embodiment, the structure of the impact head 12 and the structure of the internal core structure 14 and the manner in which the impact head 12 is rigidly mounted on the first end portion of the internal core structure 14 are fully disclosed in U.S. Pat. No. 6,202,511, issued Mar. 20, 2001, incorporated herein as aforesaid.

FIGS. 1-2 show in sectional view the exterior gripping structure 16 affixed to the lower half 17 of the internal core structure 14. In one embodiment, the exterior gripping structure 16 is comprised of an inner layer 22 of a low durometer thermoplastic rubber (TPR) and an outer layer 24 of a relatively higher durometer TPR. The inner layer 22 may be overmolded, pressed on, or otherwise formed in surrounding abutting relation to the lower end portion 17 of the internal core structure 14. The outer layer 24 may be overmolded, pressed on, or otherwise formed in surrounding abutting relation to the inner layer 22.

The inner layer 22 may be a TPR having a Shore A durometer in the range of about 10 to about 40. The inner layer 22 more preferably has a Shore A durometer of between about 30 to about 40. In one embodiment, the inner layer 22 has a Shore A durometer of about 35. The outer layer 24 is relatively harder in comparison with the inner layer 22 yet may still be flexible or resilient. The outer layer 24 may also be a TPR, and in one embodiment is the same type of TPR as the inner layer 22 so as to ensure a chemical and melt bond between the two layers. The outer layer 24 may alternatively be a different type of TPR than the inner layer 22. The outer layer 24 has a Shore A durometer in the range of about 55 to about 90. In a more preferred embodiment, the outer layer 24 has a Shore A durometer of between about 55 to about 65. In one embodiment, the outer layer 24 has a Shore A durometer of about 60. The higher durometer of the outer layer 24 lends to increased durability and decreased wear characteristics. By separating a higher durometer outer layer 24 from the internal core structure 14 with the lower durometer inner layer 22, improved torque control and vibration damping effects are realized.

One skilled in the art will appreciate that the exterior impact-cushioning gripping structure 16 can be formed on the internal core structure 14 using well known, conventional molding processes on a conventional two part or "two shot" molding machine, as described in U.S. Pat. No. 6,370,986, referred to above. The layers may, alternatively, be successively pressed on (inner layer, then outer layer). It is desirable to have different wall thicknesses at different parts of the gripping structure 16 because the butt end 34 of the gripping structure 16 may be subjected to repeated impacts, so in one embodiment the bottom wall 36 of the gripping structure 16 is thicker than the side walls 38. In one embodiment, the side walls 38 are relatively thin to improve the feel of the gripping structure and to provide improved impact cushioning.

The relatively soft inner layer 22 provides most of the torque absorption and impact cushioning when a workpiece is struck. In one embodiment, a plurality of rib or fin-like structures 40 are provided around the gripping structure 16 as shown in FIG. 2 to increase the firmness of and to rigidify of the gripping structure 16. As shown in FIG. 2, when the ribs 40 are provided on the inner layer 22, the outer layer 24 may be formed around the inner layer 22 and be held firmly in place by an interference fit or a friction fit with the ribs 40.

In a preferred embodiment, the inner layer 22 is made from a non-foamed material, as is the outer layer 24. However, in another embodiment, the inner layer 22 may be a foam material.

When a user strikes a workpiece with the tool 10, the user grips the gripping structure 16 and manually swings the tool 10 to impact the striking surface 18 on the workpiece. When the impact head 12 hits the workpiece, a portion of the kinetic energy of the impact is transferred through the internal core structure 14 back to the user's hand. In an off center hit, torsional effects are increased and are transmitted to the user.

The inner layer 22 of the exterior impact-cushioning gripping structure 16 cushions the impact and increases user comfort. Due to the low Modulus of Elasticity of a low durometer TPR, the inner layer 22 allows for equivalent angular deflection of the tool internal core structure 14 without transmitting as much torque as similar materials of higher durometer, thereby "controlling" or limiting the effects of torsion resultant from off center strikes with the tool. The inner layer 22 also more effectively dampens the vibrations that occur in the internal core structure 14 following the impact of the impact head 12 on the workpiece.

In the embodiment of the hammer shown in FIGS. 1-2, the exterior impact-cushioning gripping structure 16 is mounted on an internal core structure 14 that includes a pair of vibration receiving elements or tines 50 that extend longitudinally away from the end portion of the internal core structure 14 to which the impact head 12 is secured and terminate in spaced relation to one another. The vibration receiving elements 50 define a space 52 therebetween and the inner layer 22 of material is formed around the outer end portion 17 of the internal core structure 14 so that a portion of the inner layer 22 is received within the space 52 and surrounds the vibration receiving elements 50. The vibrations resulting when the impacting head 12 impacts a workpiece are received by the vibration receiving elements and are damped by cooperation between the elements 50 and the inner layer 22 of material to thereby reduce the vibrations that are transmitted to the hand of the user when said impact tool 10 impacts a workpiece.

Figure 3:
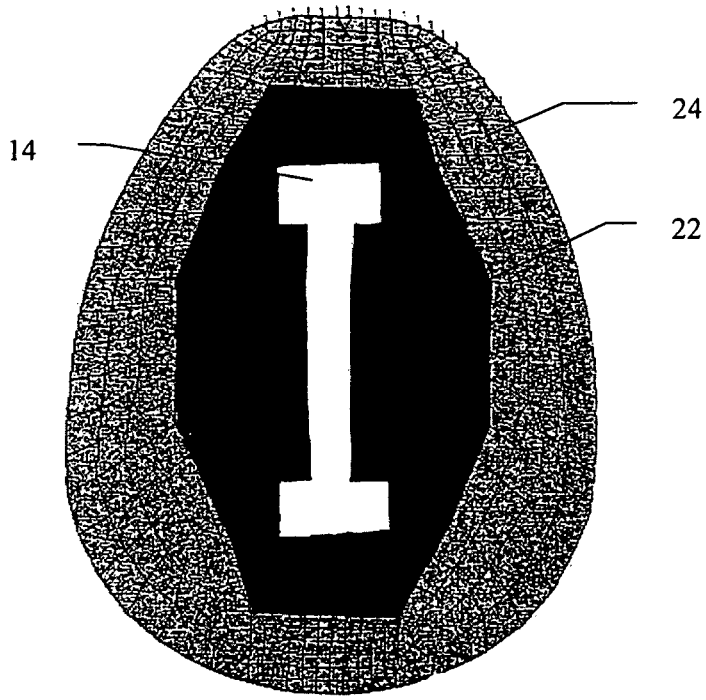
FIG. 3 is a computer-generated deformation plot of an impact tool constructed in accordance with an embodiment of the present invention.

Applying an exterior impact-cushioning gripping structure 16 reduces the transmission of torque from the internal core structure 14 to the exterior grip 16 held by the user. This is because during an "offstrike" or some type of impact in which the hammer head hits a structure in a manner that tends to impart a generally twisting action to the core structure 14 about its longitudinal axis, the core structure 14 is permitted to twist slightly about the longitudinal axis A (as represented schematically in FIG. 2), without a corresponding twist of the exterior grip portion 16. In other words, the core 14 will have the ability to twist slightly relative to the exterior grip portion 16, as the softer inner layer 22 tends to dampen this movement of the core 14 relative to exterior grip 16, so that the twisting force imparted to the exterior grip 16 is minimized (dampened). This twisting motion is shown in FIG. 3, which is a graphical representation of the cross section of an impact tool in accordance with the present invention during an in-plane torsion test. As can be seen in the Figure, the core 14 is twisted with respect to the outer layer 24 and, thus, a reduced amount of torque force is transmitted to a user.

Figure 4:
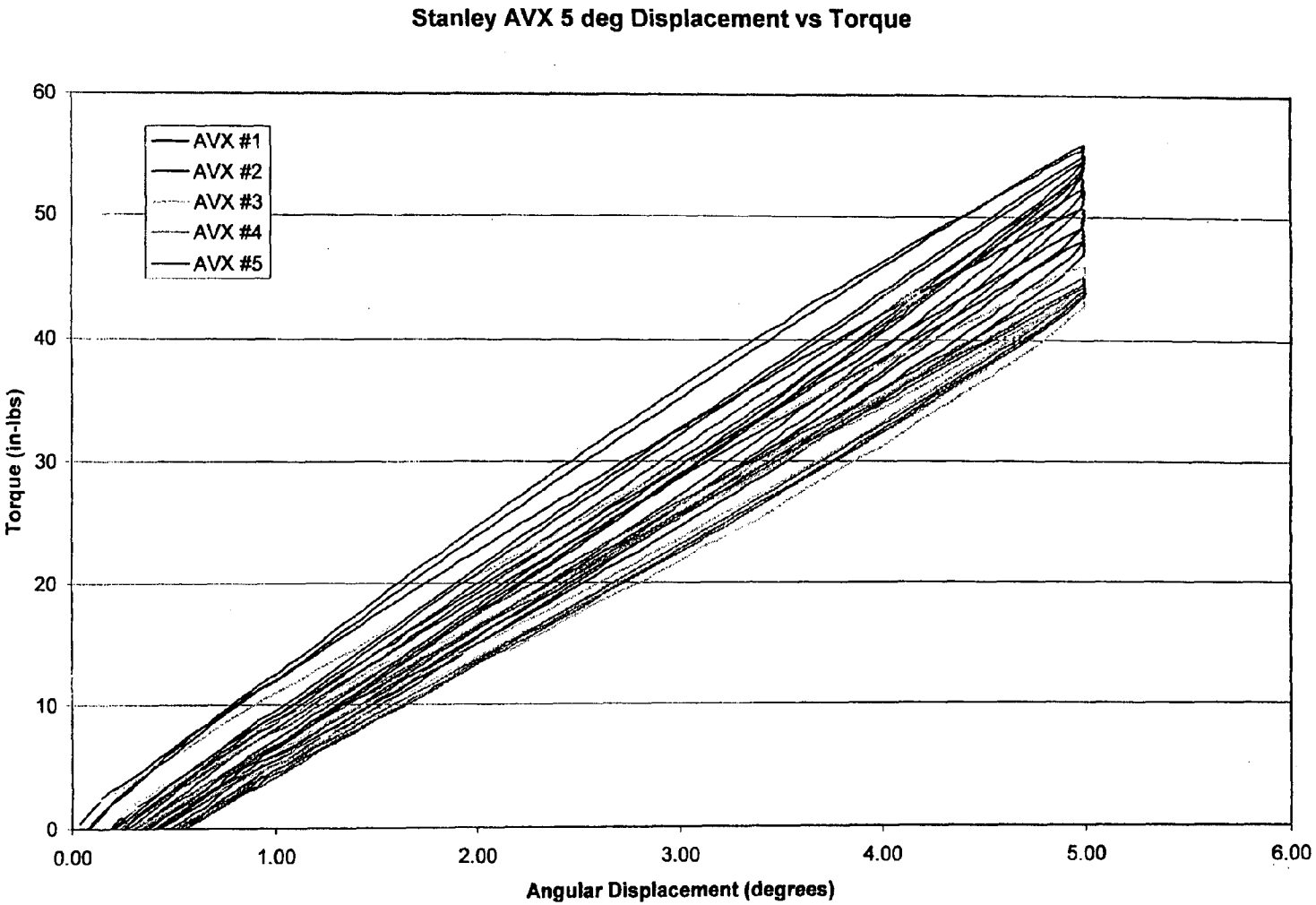
FIGS. 4 and 5 are graphs showing the transmission of an applied torque to a user-engageable portion of an impact tool constructed in accordance with an embodiment of the present invention.
Figure 5:
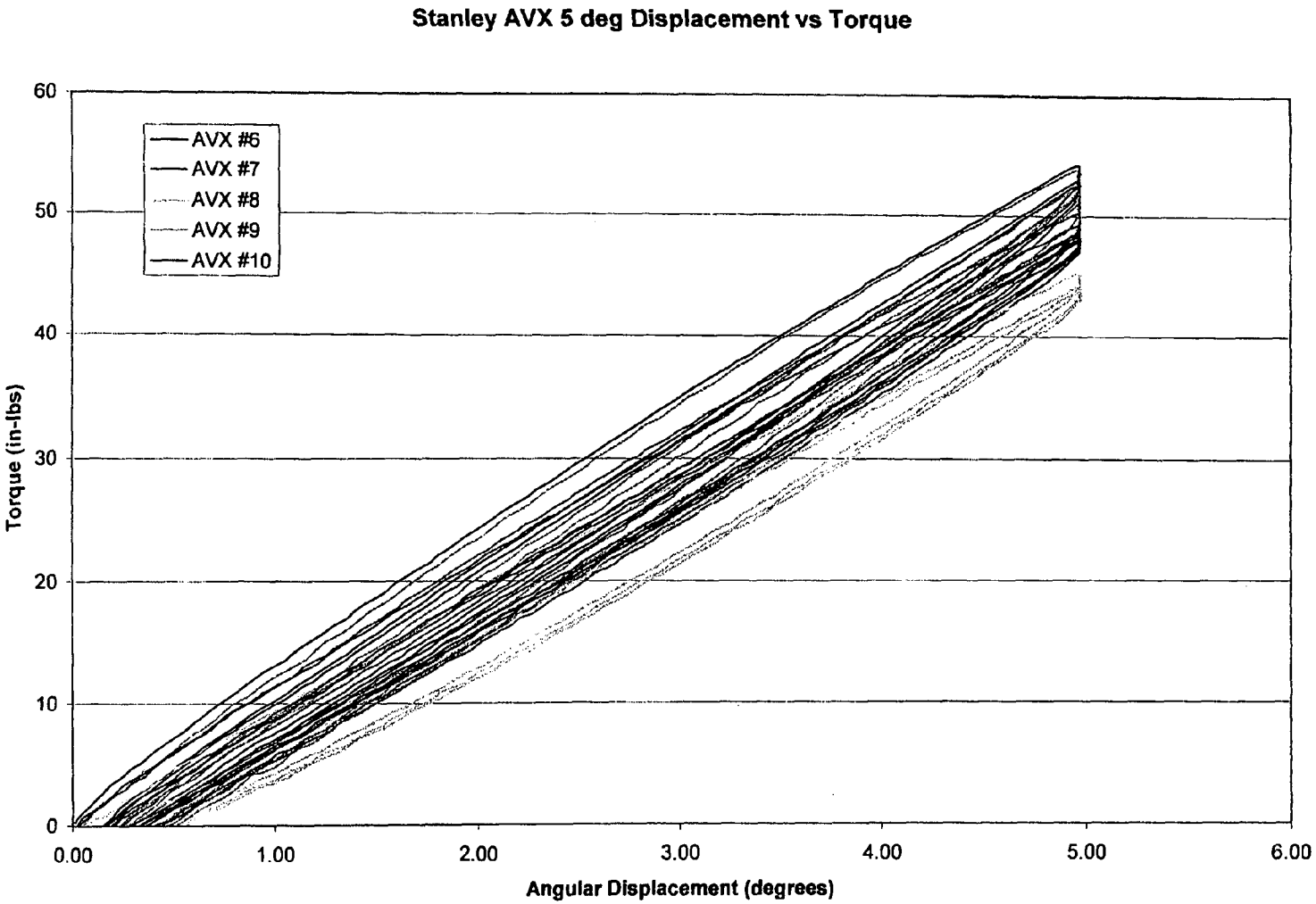
Figure 6:
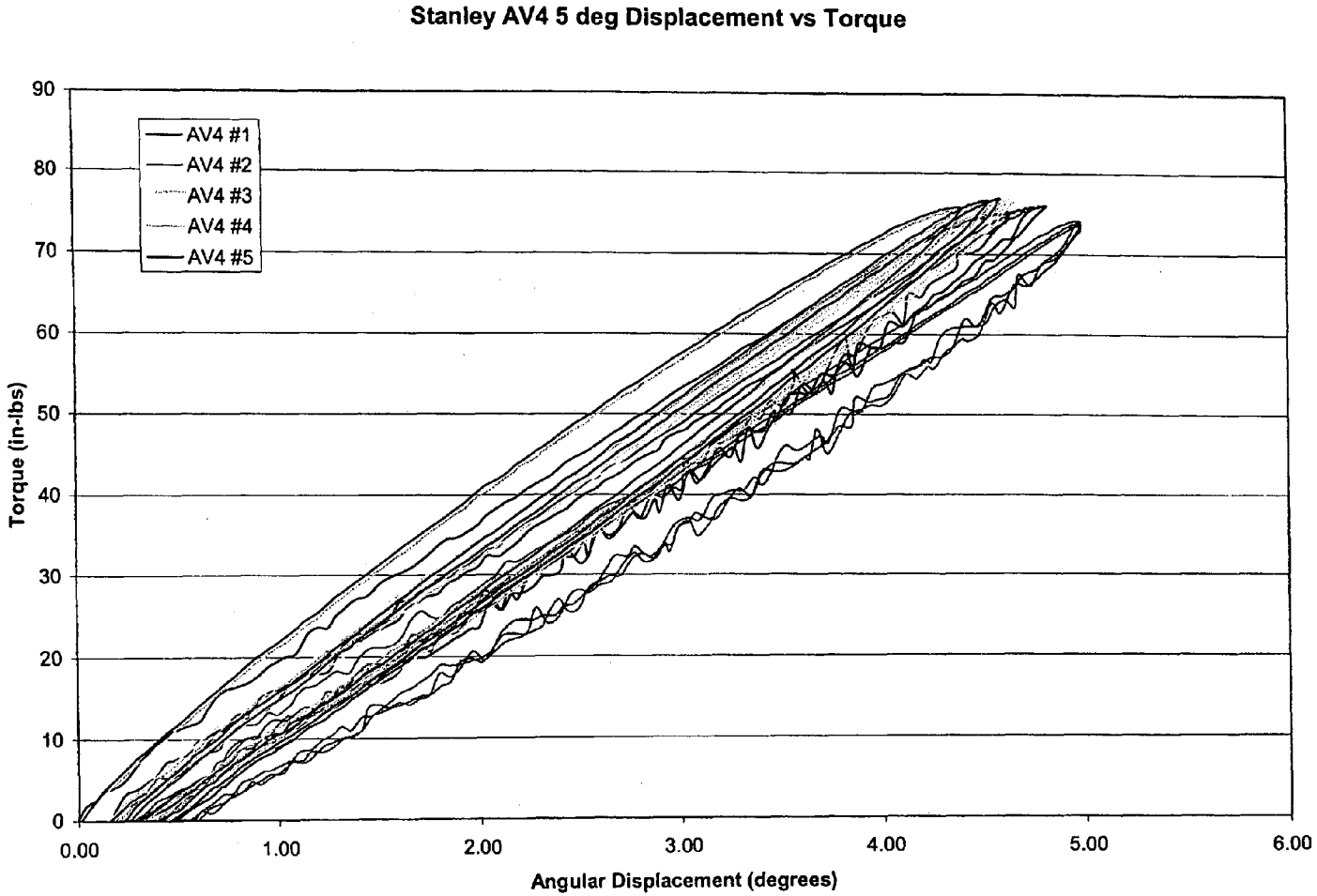
FIGS. 6 and 7 are graphs showing the transmission of an applied torque to a user-engageable portion of a conventional impact tool.
Figure 7:
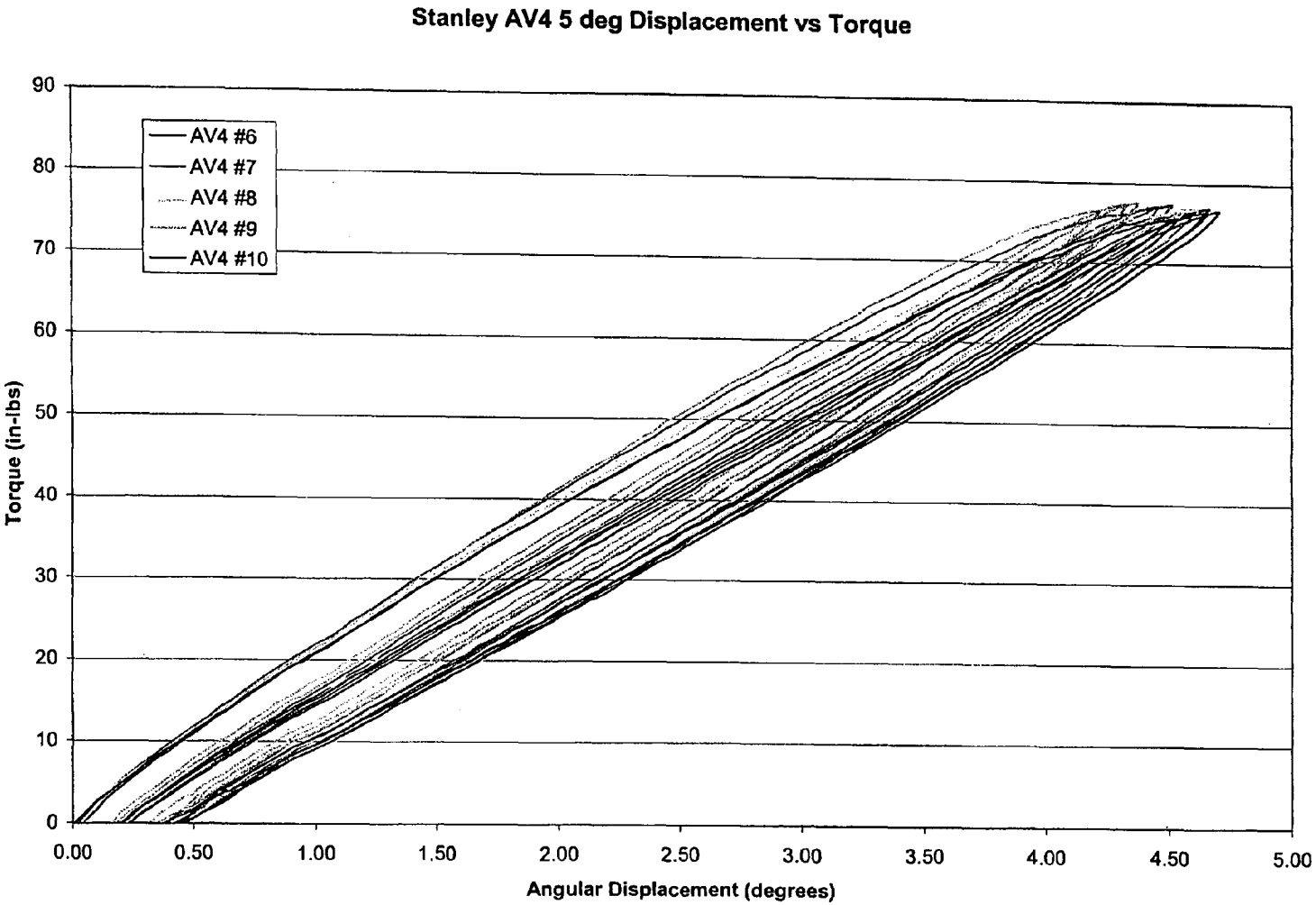

As shown by comparison of FIGS. 4 and 5 to FIGS. 6 and 7, impact tools constructed in accordance with the present invention are shown to reduce the amount of torque transmitted to the exterior grip portion 16 of the tool. The Figures demonstrate the torque transmitted to the grip 16 (vertical axis) across a five degree range of hammer head deflection (horizontal axis). FIGS. 4 and 5 illustrate such plots for ten impact tools constructed in accordance with the present invention (referred to as "AVX") while FIGS. 6 and 7 illustrate such plots for ten impact tools with a conventional construction (referred to as "AV4"). The impact tools tested in FIG. 6 and 7 each had a one-piece forged steel construction with one layer of overmolded TPR having Shore A durometer of about 65 to 70. The impact tools tested in FIGS. 4 and 5 were made in accordance with the embodiment illustrated in FIG. 1, and had a soft inner layer with a Shore A durometer of about 33 to 37, and a harder outer layer with a Shore A durometer of about 58 to 62.

As can be appreciated form a comparison of the test results of FIGS. 4 and 5 (manufactured in accordance with one embodiment of the invention) with the test results of FIGS. 6 and 7 (conventional tool), the impact tools constructed in accordance with the present invention tended to transmit less torque to the grip than did the conventional impact tools.

The following tables list the impact response dynamometer force test results conducted on six impact tools constructed in accordance with the present invention and six conventional impact tools having characteristics similar to those described above with respect to FIGS. 6 and 7.

The impact testing device incorporated a dynamometer mounting for a clamp used to hold the handle of the impact tool. The dynamometer measured the net in-plane and out of plane forces resulting from impact by an adjustable height swing arm. The impact contact point on the device was adjustable to accommodate different offset locations and impact angles. The swing arm impact tip utilized was a hard tip commonly used on impulse testing impact tools. The actual forces experienced by the dynamometer included force components acting in the direction of impact as well as force components acting in the opposite direction (due to the lever arm effect and the handle pivot point being located near the center of the dynamometer table). These forces could be resolved by a moment analysis if the location of the pivot point is known. The peak impact force could also be determined from the moment analysis if the impact force-time history is also known (measured). Additional information (impulse-momentum, etc.) could also be obtained from a calculation of the area under the force-time curves. The force measurements are in terms of peak volts as determined from the force time plots (the dynamometer sensitivity is about 20 pounds force per volt based on a static calibration of the in-plane force). The in-plane net peak force data (volts) for an offset impact location (¼" off center; directly above the head center) is shown for two selected impact swing arm height settings (corresponding to light (force level 1) and medium (force level 2) impact).

TABLE 1

Impact Tool in Accordance with the Present Invention ("A")

| Sample | Force Level 1 | Force Level 2 | Freq. (in-plane) | Freq. (out-of-plane) |
|---|---|---|---|---|
| #1 | 3.32 volts | 4.69 volts | 17.0 Hz | 10.0 Hz |
| #2 | 3.81 | 5.03 | 19.5 | 10.5 |
| #3 | 2.93 | 4.36 | 13.5 | 8.5 |
| #4 | 3.89 | 5.17 | 22.0 | 10.5 |
| #5 | 2.97 | 4.56 | 15.0 | 9.0 |
| #6 | 3.47 | 5.09 | 21.0 | 10.0 |
| Ave. | 3.62 | 4.99 | | |

TABLE 2

Conventional Impact Tool ("B")

| Sample | Force Level 1 | Force Level 2 | Freq. (in-plane) | Freq. (out-of-plane) |
|---|---|---|---|---|
| #1 | 4.98 volts | 7.23 volts | 35.0 Hz | 17.5 Hz |
| #2 | 4.96 | 6.73 | 36.0 | 17.5 |
| #3 | 5.24 | 7.30 | 36.0 | 17.5 |
| #4 | 4.59 | 7.23 | 36.0 | 17.5 |
| #5 | 4.43 | 7.12 | 36.0 | 18.5 |
| #6 | 5.13 | 7.10 | 36.0 | 19.0 |
| Ave. | 4.89 | 7.12 | | |

The in-plane net peak force data for force level 1 impacts shown above is based on time domain data averaged over 4 impacts; and is considered to be more representative than the single impact time data used to determine net peak force 2 (impacts using force level 2 were conducted last and were limited to a single test per impact tool to avoid possible handle/epoxy bonding failures). The level 2 force experiments along with several auxiliary experiments provided insight into the usefulness of low level impact testing for the type impact tools (such as with hand held instrumented impulse impact tools as opposed to the swing arm impact device). The out of plane net peak force data exhibited a similar trend as the in-plane data. However, the out of plane forces are nearly an order of magnitude lower than the in-plane forces.

The results for in-plane net peak force indicate a general reduction in net peak force measured by the dynamometer for impact tools with softer "feeling" rubber handles; with impact tool "A" appearing to softer than impact tool "B." This is generally consistent with the natural frequencies (in Hertz) for in-plane and out of plane vibration, which are also shown in the tables above for the fundamental vibration modes (in general, softer rubber would be expected to result in lower natural frequencies). The in-plane and out of plane natural frequencies were determined via a simple impulse response measurement wherein the impact tool mounted in the test fixture was impacted in the in-plane and out of plane directions and the vibration decay was observed. Small variations (±1 Hz or so) within sets of "identical" impact tools are expected due to minor variations in geometry and mounting details, however, large variations within sets (greater than 5 Hz) are indicative of significant differences between the impact tools (or the impact tool mounting details) which could be capable of significantly affecting the overall shock/vibration performance of the impact tool. The natural frequency values, spacing between the in-plane and out of plane natural frequencies, and natural frequency vibration decay rates are governed by boundary conditions (mounting), geometry, mass, stiffness and damping properties. These factors would be expected to influence the impact response forces, the rubber handle compression and spring back characteristics, and various other aspects of the overall shock/vibration behavior of the impact tools.

While specific embodiments have been described above, it will be appreciated that the invention may be practiced otherwise than as described. The descriptions above are intended to be illustrative and not limiting. Thus it will be apparent to one skilled in the art that modifications may be made to the invention as described without departing from the scope of the claims set out below.

What is claimed is:

1. A manually operable impact tool comprising:

an elongated handle;

an impact head disposed at one longitudinal end portion of the handle;

the handle including an internal core structure comprising a cross-section in the form of an I-beam, and a cushioning grip disposed over said core structure, the cushioning grip comprising:

an inner layer of thermoplastic rubber having a Shore A durometer in the range of about 10 to about 40, the inner layer being in direct contact with the internal core structure;

an outer layer of thermoplastic rubber disposed over the inner layer and having a Shore A durometer in the range of about 55 to about 90;

wherein the inner layer is directly bonded to the outer layer, and, upon impact of the head, the inner layer substantially dampens torsional movement transmitted from the I-beam of the internal core structure to the outer layer, and wherein 4 degrees of angular displacement of the impact head relative to the outer layer applies a torque of less than about 47 in-lbs to the outer layer.

2. The manually operable impact tool of claim 1, wherein the inner layer of thermoplastic rubber has a Shore A durometer of about 30 to about 40.

3. The manually operable impact tool of claim 2, wherein the outer layer of thermoplastic rubber has a Shore A durometer of about 55 to about 65.

4. The manually operable impact tool of claim 1, wherein the inner layer of thermoplastic rubber has a Shore A durometer of about 35.

5. The manually operable impact tool of claim 1, wherein the I-beam of the core structure comprises an end portion having a plurality of longitudinally extending, parallel and spaced tines embedded in the inner layer of thermoplastic rubber having the Shore A durometer in the range of about 10 to about 40, and wherein torsional movement of the tines about a longitudinal axis is received and dampened by the inner layer to thereby reduce transmission of torsional forces imparted to the outer layer.

6. The manually operable impact tool of claim 5, wherein the tines comprise at least one opening therethrough for receiving the inner layer of thermoplastic rubber having the Shore A durometer in the range of about 10 to about 40.

7. The manually operable impact tool of claim 1, wherein the outer layer of thermoplastic rubber has a Shore A durometer of about 55 to about 65.

8. The manually operable impact tool of claim 1, wherein the outer layer of thermoplastic rubber has a Shore A durometer of about 60.

9. The manually operable impact tool of claim 1, wherein the inner layer of thermoplastic rubber is a solid non-foamed material.

10. A method for making a manually operable impact tool comprising an elongated core with at least one opening therethrough and a cushioning grip, the grip substantially absorbing torque imparted to the core upon impact of the tool, the method comprising:

providing an impact head at a first longitudinal end of the core;

covering a portion of said core with a first layer of thermoplastic rubber having a Shore A durometer in the range of about 10 to about 40, the first layer of thermoplastic rubber embedded in the at least one opening of the core; and substantially covering the first layer of thermoplastic rubber by directly bonding a second layer of thermoplastic rubber on the first layer, the second layer of thermoplastic rubber having a Shore A durometer in the range of about 55 to 90, wherein 4 degrees of angular displacement of the impact head relative to the outer layer applies a torque of less than about 47 in-lbs to the outer layer.

11. The method of claim 10, wherein the first layer of thermoplastic rubber has a Shore A durometer of about 30 to about 40.

12. The method of claim 10, wherein the first layer of thermoplastic rubber has a Shore A durometer of about 35.

13. The method of claim 10, wherein the second layer of thermoplastic rubber has a Shore A durometer of about 55 to about 65.

14. The method of claim 10, wherein the second layer of thermoplastic rubber has a Shore A durometer of about 60.

15. The method of claim 10, wherein the first layer of thermoplastic rubber is a solid non-foamed material.

16. A method according to claim 10, wherein the internal core comprises a cross-section in the form of an I-beam, and wherein the grip substantially absorbs torque imparted to the I-beam upon impact of the tool.

17. A manually operable hammer comprising:

an elongated handle;

an impact head disposed at one longitudinal end portion of the handle;

said handle including an internal core structure, the internal core structure comprising a cross-section in the form of an I-beam and having a pair of longitudinally extending, parallel and spaced tines, and a cushioning grip disposed over said internal core structure, the tines disposed generally along opposite sides of a longitudinal axis of the core structure, the cushioning grip comprising:

a soft inner layer of a solid, non-foamed thermoplastic rubber having a Shore A durometer in the range of about 10 to about 40, the inner layer being in direct contact with the internal core structure;

an outer layer of thermoplastic rubber disposed over the inner layer, the outer layer being harder than the inner layer;

the inner layer being directly bonded to the outer layer, wherein the tines are embedded in the inner layer such that torsional movement of the I-beam and the tines about the longitudinal axis is received and dampened by the inner layer to thereby reduce transmission of torsional forces imparted to the outer layer, and wherein 4 degrees of angular displacement of the impact head relative to the outer layer applies a torque of less than about 47 in-lbs to the outer layer.

18. The manually operable impact tool of claim 1, wherein the inner layer and outer layer are chemically bonded to each other.

19. The manually operable hammer of claim 17, wherein torsional movement of the tines torsionally compresses the inner layer of non-foamed thermoplastic rubber.

20. The manually operable impact tool of claim 1, wherein the internal core structure has at least one opening therethrough for receiving the inner layer of thermoplastic rubber having the Shore A durometer in the range of about 10 to about 40.

21. The manually operable hammer of claim 17, wherein the internal core structure has at least one opening therethrough for receiving at least a part of the inner layer of thermoplastic rubber having the Shore A durometer in the range of about 10 to about 40.

22. The manually operable hammer of claim 17, wherein the outer layer has a Shore A durometer in the range of about 55 to about 90.

23. The manually operable hammer of claim 17, wherein the outer layer has a Shore A durometer of about 55 to about 65.

24. A manually operable impact tool comprising:

an elongated handle;

an impact head disposed at one longitudinal end portion of the handle;

the handle including an internal core structure comprising a longitudinal axis, and a cushioning grip disposed over said core structure, the cushioning grip comprising:

an inner layer of thermoplastic rubber having a Shore A durometer in the range of about 10 to about 40;

an outer layer of thermoplastic rubber disposed over the inner layer and having a Shore A durometer in the range of about 55 to about 90;

wherein, upon impact of the head, the inner layer substantially dampens torsional movement transmitted from the internal core structure to the outer layer, wherein the core structure is permitted to twist slightly about the longitudinal axis without a corresponding degree of twist of the outer layer, and wherein 4 degrees of angular displacement of the impact head relative to the outer layer applies a torque of less than about 47 in-lbs to the outer layer.

25. The manually operable impact tool according to claim 24, wherein the inner layer is in direct contact with the internal core structure.

26. The manually operable impact tool according to claim 25, wherein the inner layer is in directly bonded to the outer layer.

27. The manually operable impact tool according to claim 24, wherein the inner layer is in directly bonded to the outer layer.

* * * * *